US005366277A

United States Patent [19]

Tremblay

[11] Patent Number: 5,366,277

[45] Date of Patent: Nov. 22, 1994

[54] MODULAR PEDIATRIC SEATING SYSTEM

[75] Inventor: Camille Tremblay, Montreal, Canada

[73] Assignee: Hopital Marie-Enfant, Montreal, Canada

[21] Appl. No.: 993,401

[22] Filed: Dec. 21, 1992

[51] Int. Cl.[5] ..... A47C 7/00; A47C 7/36

[52] U.S. Cl. ..... 297/464; 297/440.13; 297/440.14

[58] Field of Search ..... 297/464, 466, 486, 219.1, 297/DIG. 4, 406, 440.13, 440.14, 440.15, 440.20, 353, 409, 411.1, 112, 440.23, 468

[56] References Cited

U.S. PATENT DOCUMENTS

| | | | |
|---|---|---|---|
| 2,591,911 | 4/1952 | Block | 297/464 |
| 3,269,768 | 8/1966 | Kinney | 297/464 |
| 3,640,571 | 2/1972 | Keropian | 297/464 |
| 3,761,126 | 9/1973 | Mulholland | 297/384 |
| 4,065,179 | 12/1977 | Takasaki | 297/384 |
| 4,234,228 | 11/1980 | Flamm | 297/464 |
| 4,538,857 | 9/1985 | Engman | 297/437 |
| 4,647,066 | 3/1987 | Walton | 297/DIG. 4 |
| 4,688,843 | 8/1987 | Hall | 297/DIG. 4 |
| 4,711,492 | 12/1987 | Asbjornsen et al. | 297/284 |
| 4,813,746 | 3/1989 | Mulholland | 297/488 |
| 4,967,864 | 11/1990 | Boyer et al. | 297/440.15 |
| 4,981,325 | 1/1991 | Zacharkow | 297/284 |
| 4,989,836 | 2/1991 | Hudson, III et al. | 297/464 |
| 5,088,747 | 2/1992 | Morrison et al. | 297/219.1 |
| 5,176,393 | 1/1993 | Robertson et al. | 297/DIG. 4 |
| 5,228,747 | 7/1993 | Greene | 297/DIG. 4 |

FOREIGN PATENT DOCUMENTS

| | | | |
|---|---|---|---|
| 571579 | 9/1983 | Australia . | |
| 2001415 | 11/1971 | Germany | 297/464 |

OTHER PUBLICATIONS

"Transporter Institutional Models", Safety Travel Chairs, Inc., Sep. 14, 1981.

*Primary Examiner*—Clifford D. Crowder
*Assistant Examiner*—Amy B. Vanatta

[57] ABSTRACT

A modular pediatric seating system is provided for supporting a disabled person, and preferably, but not exclusively, a child. The system comprises an articulated frame having a seat frame section, a back support frame section and a leg support frame section. At least the back and leg support frame sections have interconnecting slots disposed longitudinally within the frame sections. Articulated connectors are also provided to interconnect the frame sections together through the interconnecting slots permitting spacing of opposed ends of the sections and replacement of one or more of the frame sections to modify one or more dimensions of the seating system. Platforms are connected to further attachment slots of at least the back and leg support frame sections to permit displaceable positioning and securement of the platforms to the support frame sections. At least the platforms of the back support frame section have adjustable lateral restraining members provided in pairs for maintaining a disabled person's upper body in a substantially straight position.

15 Claims, 4 Drawing Sheets

MODULAR PEDIATRIC SEATING SYSTEM

TECHNICAL FIELD

The present invention relates to a modular pediatric seating system for supporting a disabled person, and preferably, but not exclusively, a child, and wherein the system is comprised of articulated frame sections which are interconnected through an extensible and articulated connector, and wherein the frame sections are replaceable to provide modification of the seating system in order to accommodate persons of different sizes, or a specific child as his physiognomy changes. The modular pediatric seating system supports the disabled person on conventional chairs, wheelchairs, strollers, etc.

BACKGROUND ART

Various types of complex pediatric seating systems or upright support systems having various adjustable mechanisms are known for supporting a disabled person in specific positions. However, such systems are complex in construction and expensive to fabricate. They are usually custom-built to fit a person of a specific physiognomy, and therefore need to be replaced as that physiognomy changes. Most of these systems are adapted to specific devices, such as wheelchairs, and not adaptable for different functions such as also serving as support for conventional chairs, automobile seats, high chairs. A typical example of such system is illustrated and described in U.S. Pat. No. 3,761,126. That patent is restricted to a wheelchair wherein various component parts of the wheelchair are provided with adjustable mechanisms to adapt to the dimensions of a disabled person. These adjustable mechanisms are cumbersome and costly. They are also time consuming to adjust and secure to a disabled person on the wheelchair.

U.S. Pat. No. 4,234,228 relates to a modular articulated seating system for handicapped persons to hold a handicapped person securely in an orthopaedically required position. The seating system comprises a frame having three shells with a cushioning system secured to the shells, but molded to closely fit a specific person's body. They must be replaced when the body of the person is different. However, the shells or the seating system is adapted to be mounted on a variety of devices, such as the base of a wheelchair, carseat, etc. The present invention relates more generally to this type of device, but of entirely different structure providing a variety of advantages not derivable from this patented structure and some of which advantages are described hereinbelow.

SUMMARY OF INVENTION

It is a feature of the present invention to provide a novel modular pediatric seating system for supporting a disabled person, and preferably, but not exclusively, a child, and wherein the seating system may be easily modified to adapt to disabled persons of different physiognomy and further wherein the seating system may be supported on all types of devices usually utilized by disabled persons, such as wheelchairs, standard chairs, car seats, strollers, etc.

Another feature of the present invention is provide a modular pediatric seating system for supporting a disabled person, and preferably, but not exclusively, a child, and wherein the seating system consists of support frame sections which are extensible and articulatable, and further wherein frame sections are replaceable to vary the dimension of the seating system.

Another feature of the present invention is to provide a modular pediatric seating system for supporting a disabled person, and preferably, but not exclusively, a child, and wherein platforms are adjustably securable to the support frame sections to further vary the dimensions of the seating system and wherein the back support frame section has platform sections, one or more of which is provided with adjustable lateral restraining means for maintaining a disabled person's upper body in a substantially straight position.

Another feature of the present invention is to provide a modular pediatric seating system for supporting a disabled person, and preferably, but not exclusively, a child, and wherein cushioning pads are removably securable to the seating and back support platforms.

Another feature of the present invention is to provide a modular pediatric seating system for supporting a disabled child up to the age six years old or more, and wherein the seating system is expandable to adjust to the growth of the child.

Another feature of the present invention is to provide a modular pediatric seating system for supporting a disabled person, and preferably, but not exclusively, a child, and wherein the seating system is easily assembled and modified, such as to provide a seating system which is custom-fit to the disabled person.

Another feature of the present invention is to provide a modular pediatric seating system for supporting a disabled person, and preferably, but not exclusively, a child, and wherein the seating system can be utilized on wheelchairs, strollers, standard chairs, highchairs, and automobile seats, or other useful items.

Another feature of the present invention is to provide a modular pediatric seating system for supporting a disabled person, and preferably, but not exclusively, a child, and wherein the support frame sections of the seat are fabricated from an extruded support member which can be cut to desired lengths to fabricate a customized seat, or to modify the dimensions of an existing seat, and wherein such modification of construction can be effectuated by non-skilled persons and in a very short time as compared to prior art systems which require fabrication in manufacturing plants.

According to the above features, from a broad aspect, the present invention provides a modular pediatric seating system for supporting a disabled person, and preferably, but not exclusively, a child. The system comprises an articulated frame having a seat frame section, a back support frame section and a leg support frame section. At least the back and leg support frame sections have interconnecting means disposed longitudinally within the frame sections. Articulated connector means is provided to interconnect the frame sections together through the interconnecting means and permitting replacement of one or more of the frame sections to modify one or more dimensions of the seating system. Platform means is connected to attachment means of at least the back and leg support frame sections to permit displaceable positioning and securement of the platform means to the support frame sections. At least the platform means of the back support frame section has adjustable lateral restraining means for maintaining a disabled person's upper body in a substantially straight position.

BRIEF DESCRIPTION OF DRAWINGS

A preferred embodiment of the present invention will now be described with reference to the accompanying drawings, in which.

DESCRIPTION OF PREFERRED EMBODIMENTS

Figure 1:
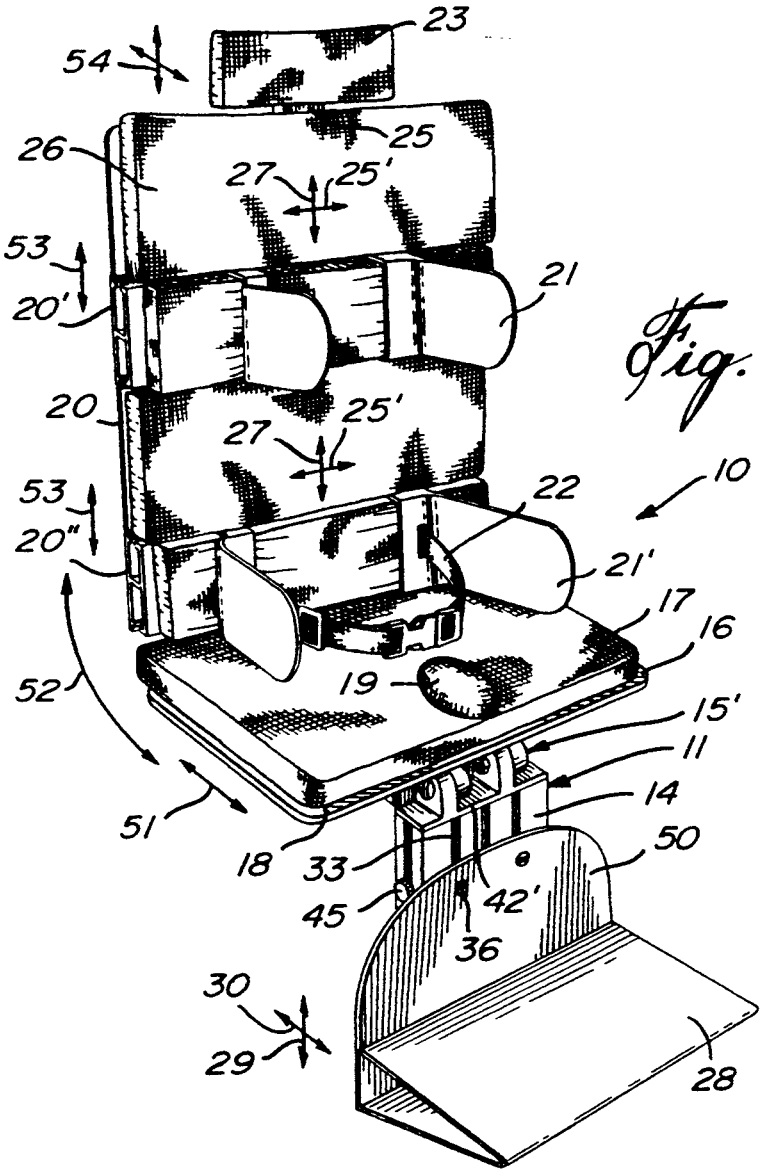
FIG. 1 is a perspective view of the modular pediatric seating system of the present invention.
Figure 2:
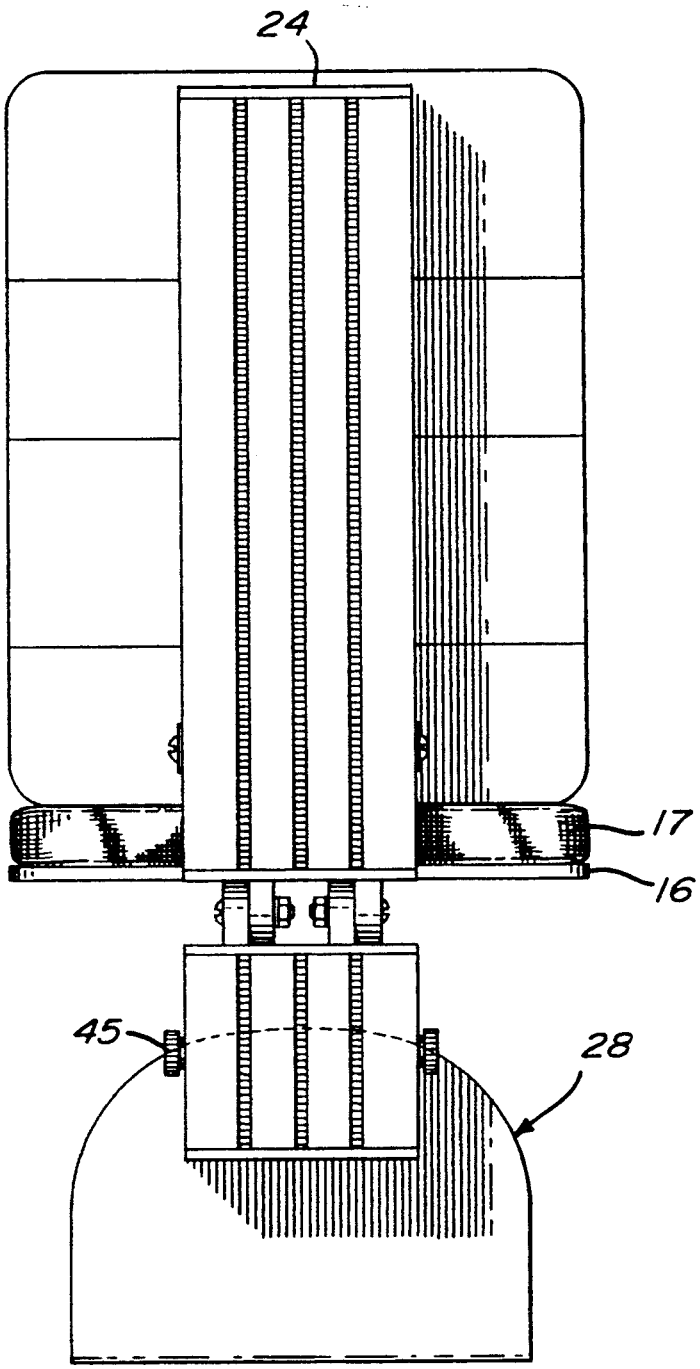
FIG. 2 is a rear view of the modular pediatric seating system illustrating the interconnection of the support frame sections.
Figure 3:
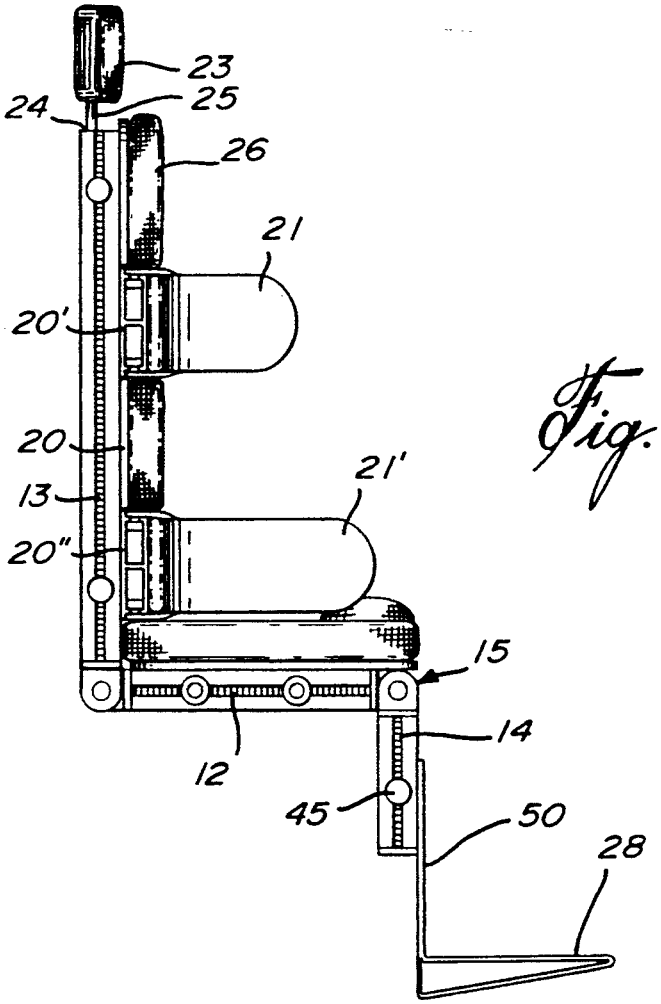
FIG. 3 is a side view of the modular pediatric seating system.

Referring now to the drawings, and more particularly to FIGS. 1 to 3, there is shown generally at 10 the modular pediatric seating system of the present invention for supporting a disabled person, and preferably, but not exclusively, a disabled child. The seating system was conceived for supporting infants between the ages of zero to six and weighing less than 50 pounds, and inflicted with muscular dystrophy, cerebral palsy, head injury, muscular skeletal deficiencies, paraplegia or quadriplegia, and other problems.

Figure 5B:
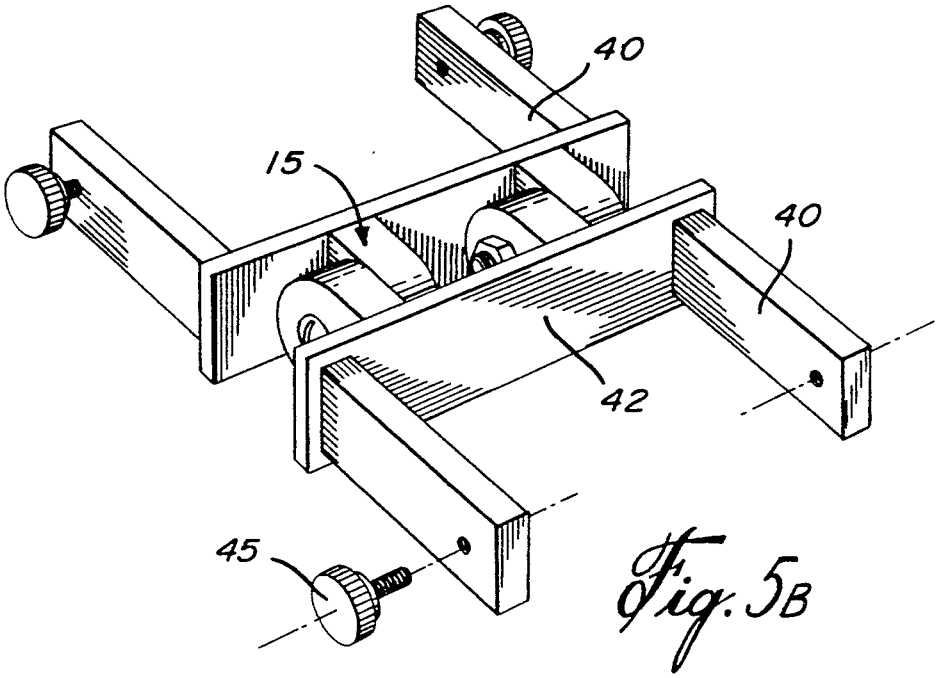
FIG. 5B is a perspective view further illustrating the interconnection and construction of the support frame sections.

The modular pediatric seating system 10 is comprised essentially of an articulated frame 11 constituted by a seat frame section 12, a back support frame section 13, and a leg support frame section 14. The support frame sections 12, 13 and 14 are interconnected together by articulated connector means in the form of hinge connectors 15, as further illustrated in FIGS. 5A and 5B. These connector means provide for the support frame sections to be spaced from their adjacent ends and articulated to desirable angles and arrested at such desired angles.

A seat platform 16 is secured to the seat frame section 12 and a cushioned pad 17 is removably attached to the top face of the seat platform by releasable securement means, such as Velcro (registered trademark) tabs 18, secured to the top surface of the seat platform and to the underside of the pad in juxtaposed areas. The pad 17 may be provided with an abductor or a thigh cushion 19 for positioning the thighs of a person. A plurality of transverse panels 20 are also removably secured to tile back support frame section 13 with some of the back panels, namely panels 20, and 20'', having adjustable lateral restraining means in the form of pairs of spaced apart restraining members 21 and 21' secured thereto and extending substantially transverse to the laterally disposed back rectangular panels 20. As herein shown, these restraining members 21 and 21' are paddle-like members with the lower pair of members 21' being secured to the lowermost panel 20'' for restraining the pelvis of a person seated on the seat pad 17. A belt 22 maintains the pelvis body portion of the person firmly between the lower members 21'. The configuration and length of the restraining members may be modified to suit particular cases. These upper restraining members may have pads (not shown) secured thereto for comfort. A headrest member 23 is provided in the top end 24 of the rear support frame section 13. The headrest member 23 is removably connected and slidingly secured to a connector member 25 which secures within the top end 24 of the back support frame section and provided for adjustablity.

Cushion pads 26 are also removably secured to the back panels 20 by releasable connectors of the type provided for the seat cushion pad 17. The construction of the restraining members 21, 21' will be discussed later, but it is pointed out, with respect to FIG. 1, that these are displaceably connected to the back panels 20' and 20'', respectively, for lateral adjustment therewith in the direction of arrows 25'. The back panels 20 are also displaceable in the direction of arrows 27, i.e., the vertical direction, to extend the length of the back portion of the seat. It is further pointed out that these back panels are easily interchangeable and can be provided in different widths and lengths.

To the leg support frame section 14 there is adjustably connected a footplate 28 for supporting the feet of the person. The footplate is adjustable vertically on the lower support frame section 14 in the direction of arrows 29, or rearwardly and forwardly in the direction of arrow 30 by displacement of the hinge connector 15'.

Figure 4:
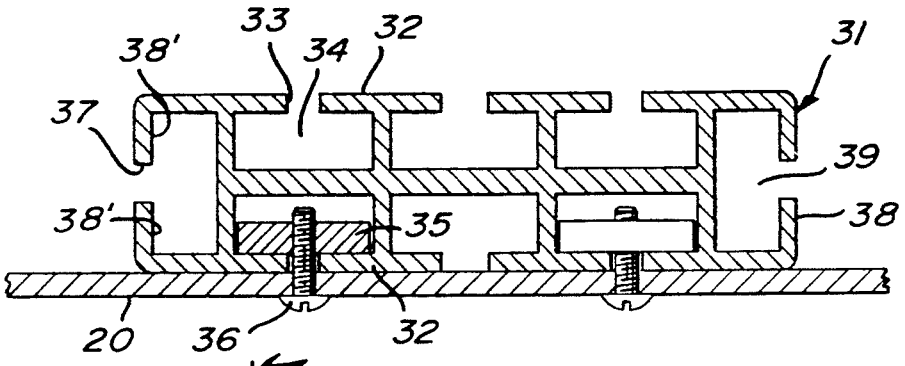
FIG. 4 is a cross-section view of one of the support frame sections.

With specific reference to FIGS. 4 and 5, it can be seen that the support frame sections 12, 13 and 14 are each constituted by rectangular extruded elongated hollow support frame members 31 of predetermined lengths. These members are formed from extruded aluminum or structural plastics, or any other suitable material. The extruded frame section 31 defines interconnected webs forming opposed flat surfaces 32 having connecting slots 33 extending from end to end of the extruded members 31, and at least on a connecting outer one of the opposed flat surfaces 32. These slots lead to channels 34 formed within the extruded frame members 31 to receive therein connector nuts 35 secured to the threaded bolts 36 for attaching the rectangular panels or platforms 16 and 20 to the extruded frame members 31. These panels are slid from the open end, such as the top end 24 of the extruded frame member 13, and by tightening the threaded bolts 36 they are secured at the desired position along the frame members. Accordingly, it is very simple to secure the platform members to the frame members, and to modify their position when necessary to vary or adjust the configuration of the seating system.

As also shown in FIG. 4, the extruded frame members 31 are further provided with side slots 37 in the end walls 38 thereof. These side slots lead to side channels 39 which receive the connecting flanges 40 of the hinge connectors 15 which project from a rear wall 41 of a pair of hinge plates 42 of the hinge connectors 15.

The connecting flanges 40 of the hinge plates 42 are provided with transverse locking screws 43 having a threaded shaft 44 engaged with the connecting flange and a finger operated wheel member 45 for rotating the threaded bolt. The hinge plate is connected to the end 24' of one of the support frame sections 12, 13 or 14 by inserting the connecting flanges 40 in a respective one of the side channels 39 of the extruded frame member and locked at a desired position either with the hinge plate 42 resting on the end edge of the open end 24', or spaced therefrom. The hinge plate is arrested at the desired position by turning the wheels 45 to frictionally engage and arrest the connecting flanges 40 against the inner opposed surfaces 38' of the end walls 38. The flanges 40 only provide a minimal extension of the frame members.

Figure 5A:
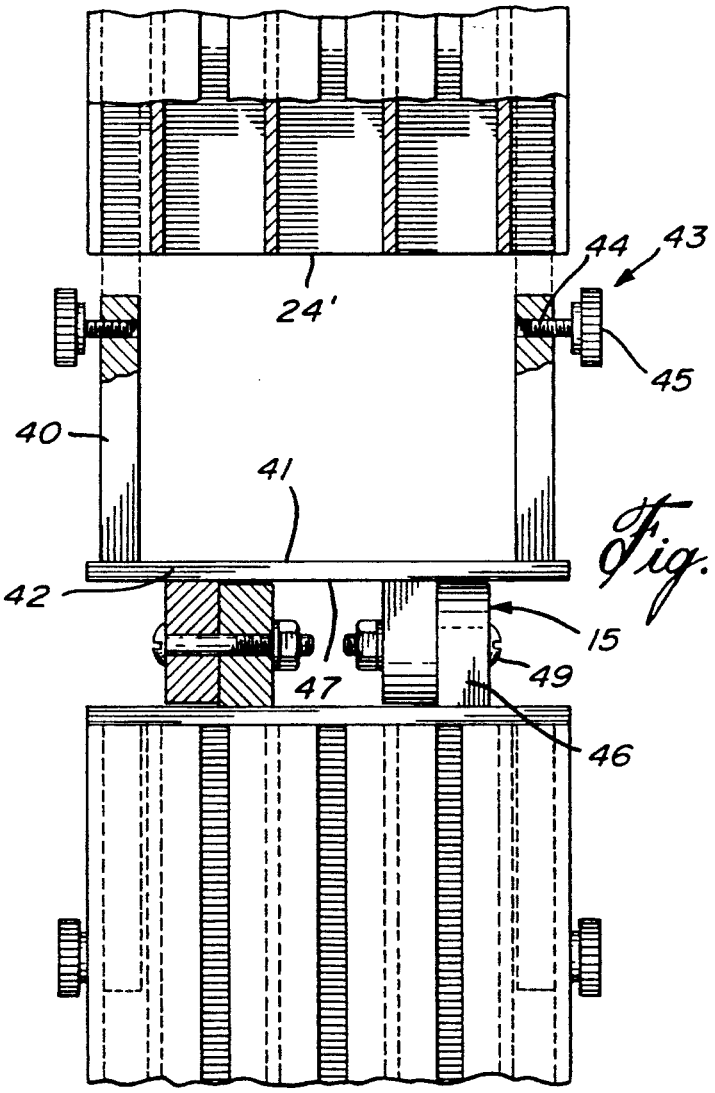
FIG. 5A is an elevational view illustrating the interconnection of the support frame sections.

The articulated hinge connector 15 is comprised of a pair of these hinge plates 42 which are interconnected together by hinge pin connecting flanges 46 extending spaced apart from a front wall 47 of the hinge plate with the connectors 46 of adjacent hinge plates 42 being offset and alignable in friction side contact with one another to receive a connecting hinge bolts 49, as shown in FIG. 5A, to secure these connectors 46 together. Accordingly, the extruded frame members 31 are interconnected in an articulated manner and their interconnected ends are spaced apart a distance as determined by the hinge connectors 15. Also, their angle is adjustable by the hinge bolts 49. It is further pointed out that the frame dimensions can be changed by interchanging the extruded frame members 31 to make them longer or shorter and adding or removing platform sections. An advantage of the modular pediatric seating system of the present invention is that the extruded frame members may be provided to the fabricator of the modular seat in long sections, and these long sections can then be cut to desired lengths as needed. This eliminates the necessity of supplying a multitude of parts and maintaining costly inventories to construct seating systems of different sizes. Accordingly, the modular seating system may be easily custom-fit to the patient. The channels and slots within the extruded frame members extend end to end thereof.

As shown in FIGS. 1 and 2, the foot plate 28 is provided with a flat attachment wall 50 which is secured to the connecting slots 33 by the threaded bolts 36 and at any desired location along the slot 36 to vary the distance between the foot plate 28 and the seat pad 17 so as to support the feet of the handicapped person to be seated on the seating system. Another means of further varying the distance between the foot plate and the seat pad cushion 17 is by rotating the wheels 45 to disconnect the connecting flanges 40 secured to the hinge plate 42' and to tighten the screws once the foot plate is lowered to the desired position. The seat platform or panel 16 may also be constructed in sections to vary the length thereof in the direction of arrow 51. Arrow 52 illustrates the articulation feature between the seat and the backrest. The arrows 53 illustrate the displacement of the back panels 20 with respect to the back support frame member. The headrest 23 may also be provided on an articulated hinge connector 15 to adjust its position both vertically and horizontally, as indicated by arrow 54.

Figure 6:
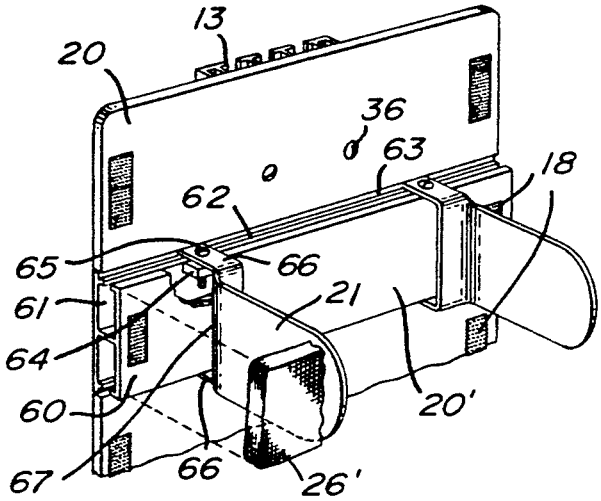
FIG. 6 is a fragmented perspective view illustrating the construction of the back section and of the seating system.

As shown in FIG. 6, the back panels 20 are rectangular panels securable at desired locations along the back support frame member 13, and securable at a desired location by the threaded bolts 36. The back panel members 20' and 20'' are constructed differently than the back panels 20. The panels 20' and 20'' are constituted by extruded members, such as member 60, and define opposed connecting channels 61 with a connecting slot 62 extending along the edge wall 63 of the extruded back panel 60 to receive therein the threaded arresting members 64 engaged with threaded bolts 65 of bridge arms 66 formed at opposed ends of a bridge member 67 from which the paddle-like restraining members 21 extend. As herein shown, these members 21 are flat members extending substantially transverse from the back panel 60, and the bridge arms 66 permit a clearance for the back cushion pad 26'. The restraining members are therefore slidingly displaced along the connecting slots 62 of the extruded back panel 60 and fixed at a desired position by tightening the threaded bolts 65 at opposed ends of the bridge arms 66.

It can be appreciated that the modular pediatric seating system of the present invention is simple in construction utilizing very few parts, with all parts being easily connected together and easily interchangeable. The seating system can be constructed by the lay person with a simple instruction sheet requiring only a screwdriver. The advantages of the modular construction and the fact that the seat parameter may be modified very quickly permits the seat to be adjusted to fit the change in physique of a growing child thereby further eliminating the necessity to have to buy a complete new seat each time the child outgrows it. The seating system is also quickly adjustable to adapt the seating system to suit various uses and, for example, as a support on a wheelchair, a stroller, a fixed chair, etc. The construction of the seat is lightweight and aesthetic with cushions of different colors being easily attachable and detachable from the support platform, and this feature is extremely important to children, as it personalizes the seat and makes it easy for a disabled child or an older person to accept the seat. It is further pointed out that other accessories may be secured to the seating system, such as shoulder straps, a work table, and other support elements, similar to the lateral restraining members, head straps, armrests, leg and foot straps, etc. It is within the ambit of the present invention to further cover any obvious modifications of the modular pediatric seating system described herein, provided such modifications fall within the scope of the appended claims.

The embodiment of the invention in which an exclusive property or privilege is claimed are defined as follows:

1. A modular pediatric seating system for supporting a disabled person, said system comprising an articulated frame having an expandable seat frame section, a back support frame section and a leg support frame section, at least said back and leg support frame sections have interconnecting means disposed longitudinally within said frame sections, articulated connector means to interconnect said frame sections together through said connector means and permitting replacement of one or more of said frame sections to modify one or more dimensions of said seating system, platform means connected to attachment means of at least said back and leg support frame sections to permit displaceable positioning and securement of said platform means to said support frame sections, at least said platform means of said back support frame having adjustable lateral restraining means for maintaining a disabled person's upper body in substantially a straight position, said interconnecting means and attachment means being provided by slots formed in said frame sections, said support frame sections being rectangular extruded elongated hollow support frame members of predetermined length, said straight connecting slots extending from end to end of said frame sections at least in a connecting surface thereof, said articulated connector means being a hinge connector comprised of a pair of hinge supports, each support having hinge pin connectors, said hinge pin connectors of each hinge support being offset and alignable in frictional side contact with each other to receive a connecting hinge bolt to interconnect said hinge supports and said frame sections in alignment and disposed at a desired angle, each hinge support having a connecting flange at opposed ends thereof on an opposite side from said hinge pin connectors, said connecting flanges being removably secured in an end of said frame sections and extending therein.

2. A modular pediatric seating system as claimed in claim 1 wherein said platform means of said back and seat support frame sections have a cushioned top surface.

3. A modular pediatric seating system as claimed in claim 1 wherein said platform means connected to said back support frame section is a plurality of laterally disposed rectangular panels.

4. A modular pediatric seating system as claimed in claim 3 wherein said adjustable lateral restraining means comprises at least one pair of spaced apart restraining members extending forwardly and substantially transverse to said laterally disposed rectangular panels.

5. A modular pediatric seating system as claimed in claim 4 wherein said restraining members are displaceably connected by a sliding connection to one of said plurality of laterally disposed rectangular panels to adjust the distance between said spaced apart restraining members.

6. A modular pediatric seating system as claimed in claim 5 wherein said one of said laterally disposed rectangular panels is provided with elongated connecting slots in a top and lower longitudinal edge thereof, said sliding connection being in clamping engagement with said connecting slots.

7. A modular pediatric seating system as claimed in claim 6 wherein said cushioned top surface is constituted by cushion pads removably secured over said laterally disposed rectangular panels and said platform means of said seat frame section.

8. A modular pediatric seating system as claimed in claim 7 wherein said sliding connection is a bridge member extending over said cushion pad secured to said one of said laterally disposed rectangular panels, said bridge member having transverse clamping connectors slidable in a respective one of said connecting slots and having arresting means to immovably arrest said restraining member, said restraining member being a flat plate member.

9. A modular pediatric seating system as claimed in claim 7 wherein said cushion pads and said platform means of said back support and seat frame sections are provided with complimentary connecting elements for ease of attachment and detachment of said cushion pads to said platform means.

10. A modular pediatric seating system as claimed in claim 7 wherein there are two pairs of spaced apart restraining members, one of said pairs being connected to a lower one of said plurality of laterally disposed rectangular panels.

11. A modular pediatric seating system as claimed in claim 10 wherein there is further provided strap means to restrain a disabled person in a seated posture on said platform means.

12. A modular pediatric seating system as claimed in claim 10 wherein there is further provided a head rest member removably connected to a top one of said plurality of laterally disposed rectangular panels.

13. A modular pediatric seating system as claimed in claim 1 wherein a platform means is also connected to said slots of said leg support frame section and constituted by an outwardly extending foot plate, and arrestable sliding connectors secured to said connecting slots of said leg support frame section.

14. A modular pediatric seating system as claimed in claim 1 wherein said support frame sections are aluminum extruded elongated hollow support frame sections, said frame sections being symmetrical sections defining at least two of said connecting slots spaced apart on opposed sides thereof, said slots extending into said cavities, there being a longitudinal end-to-end cavity in opposed side edges of said frame sections, said pediatric seat being modifiable in dimension by interchanging said frame sections with frame sections of different lengths whereby adapting said pediatric seat to a disabled person of different size.

15. A modular pediatric seating system for supporting a disabled person, said system comprising an articulated frame having an expandable seat frame section, a back support frame section and a leg support frame section, at least said back and leg support frame sections have interconnecting means disposed longitudinally within said frame sections, articulated connector means to interconnect said frame sections together through said connector means and permitting replacement of one or more of said frame sections to modify one or more dimensions of said seating system, platform means connected to attachment means of at least said back and leg support frame sections to permit displaceable positioning and securement of said platform means to said support frame sections, at least said platform means of said back support frame having adjustable lateral restraining means for maintaining a disabled person's upper body in substantially a straight position, said interconnecting means and attachment means being provided by slots formed in said frame sections, said support frame sections being rectangular extruded elongated hollow support frame members of predetermined length, said straight connecting slots extending from end to end of said frame sections at least in a connecting surface thereof, said articulated connector means being a hinge connector comprised of a pair of having supports, each support having hinge pin connectors, said hinge pin connectors of each hinge support being offset and alignable in frictional side contact with each other to receive a connecting hinge bolt to interconnect said hinge supports and said frame sections in alignment and disposed at a desired angle, each hinge support having a connecting flange at opposed ends thereof on an opposite side from said hinge pin connectors, said connecting flanges being removably secured in an end of said frame sections and extending therein, said support frame sections being aluminum extruded elongated hollow support frame sections, said frame sections being symmetrical sections defining at least two of said connecting slots spaced apart on opposed sides thereof, said slots extending into side cavities, there being a longitudinal end-to-end cavity in opposed side edges of said frame sections, said pediatric seat being modifiable in dimension by interchanging said frame sections with frame sections of different lengths whereby adapting said pediatric seat to a disabled person of different size.

* * * * *